United States Patent [19]

Cornelison

[11] Patent Number: 4,748,838

[45] Date of Patent: Jun. 7, 1988

[54] PROCESS FOR MAKING OBLIQUELY CORRUGATED THIN METAL STRIPS

[75] Inventor: Richard C. Cornelison, Hiram, Ohio

[73] Assignee: W. R. Grace & Co., New York, N.Y.

[21] Appl. No.: 50,413

[22] Filed: May 18, 1987

[51] Int. Cl.[4] ..... B21D 13/04; B21D 13/10

[52] U.S. Cl. ..... 72/185; 72/196; 72/379; 225/2; 225/5; 493/352; 493/463; 29/413; 29/415; 29/417

[58] Field of Search ..... 72/185, 187, 196, 197, 72/379; 29/157 R, 413, 415, 417; 493/352, 463; 225/2, 5

[56] References Cited

U.S. PATENT DOCUMENTS

| | | | |
|---|---|---|---|
| 2,798,515 | 7/1957 | York | 72/196 |
| 3,447,352 | 6/1969 | Miller | 72/187 |
| 3,825,412 | 7/1974 | Mullender | 29/415 |

FOREIGN PATENT DOCUMENTS

| | | | |
|---|---|---|---|
| 2452908 | 5/1975 | Fed. Rep. of Germany | 72/379 |
| 159220 | 10/1982 | Japan | 72/196 |
| 791378 | 2/1958 | United Kingdom | 72/185 |

*Primary Examiner*—Lowell A. Larson

*Attorney, Agent, or Firm*—Steven T. Trinker

[57] ABSTRACT

A method for making a corrugated thin metal strip wherein corrugations are linear and extend obliquely from one longitudinal marginal edge to the opposite longitudinal marginal edge of the strip. The invention involves passing the thin metal strip through corrugating rolls for impressing a series of single apex, V-shaped chevron corrugations into the surface of the metal strip. The rolling of the strip between the helical gears is done in such a way that the apex of the V-shaped chevron is the last portion to leave the corrugating rolls whereby the apex is in tension and enables metal strip to be split into two obliquely corrugated metal strips along the apices of the chevron.

4 Claims, 1 Drawing Sheet

PROCESS FOR MAKING OBLIQUELY CORRUGATED THIN METAL STRIPS

This invention relates, as indicated, to a process for making an obliquely corrugated thin metal strip wherein the corrugations are linear, extend from one marginal edge across the strip to the opposite marginal edge in a straight line, said straight line being at an angle to the longitudinal marginal edge.

BACKGROUND OF THE INVENTION

One of the principal uses of corrugated thin metal strip (0.001" to 0.010") has been the production of supports for various kinds of catalysts for carrying out various chemical reactions, such as oxidation, reduction, particulate trapping, etc., and, more recently, in the preparation of catalytic elements for use in catalytic converters positioned in the exhaust lines of internal combustion engines, for example, automotive vehicles, to eliminate by catalytic means various pollutant materials.

Up to present time, supports for the catalyst or catalysts and particulate traps which effect the desired pollution reducing effects have been made from ceramic materials in the form of the familiar "honeycomb". The inner walls of the monolithic honeycombs are coated with a precious metal catalyst or a plurality of catalysts, such as platinum, paladium and/or rodium. Hot exhaust gas coming into contact with the surfaces carrying the catalyst material undergoes chemical change to harmless materials. An early embodiment of a metallic catalyst carrier is described in U.S. Pat. No. 1,636,685 dated July 26, 1927 and issued to Downs. According to Downs, iron particles are treated by dipping into melted aluminum or by milling with powdered aluminum. In a process called calorizing, there takes place an alloying action between the aluminum and the iron, the iron-/aluminum surface provides a very satisfactory surface upon which to deposit catalytic materials, e.g., oxide catalysts such as metal oxides of groups V and VI of the periodic tables. These structures are adapted for vapor phase catalytic oxidation of organic compounds. Numerous other patents have issued including the patent to Sutter U.S. Pat. No. 2,658,752 dated Nov. 10, 1953. This patent discloses stainless steel as the base metal for the catalyst. The base metal may be in the form of a wire or screen or other physical form.

The U.S. Patent to Retallick U.S. Pat. No. 4,301,039 dated Nov. 17, 1981 discloses a method of making a metal catalyst support in spirally wound form whereby indentations in the surface will prevent nesting together when the strip is wound as a spiral.

U.S. Pat. No. 4,402,871 to Retallick dated Sept. 6, 1983 discloses a honeycomb catalyst support formed by folding a single layer of metal back and forth upon itself. Each layer in the honeycomb has indentations of uniform height so that the spacing between the layers is equal to this height. A different pattern of indentations is used on alternate layers and the indentations are of opposite sides of the strip in alternate layers. This structure prevents nesting of confronting layers. The more recent structures are made of thin ferritic stainless steel strip of the type referred to by Kilbane in patent application Ser. No. 741,282 filed June 4, 1985, now U.S. Pat. No. 4,686,155, and by Retallic in U.S. Pat. 4,601,999 dated July 22, 1986 which strip is corrugated and then fan folded or folded back and forth upon itself. The surface of the strip is provided with a catalytically active agent for decontaminating an exhaust gas e.g., the exhaust gas generated by an internal combustion engine.

More recent developments have resulted in the production of a strip of metal adapted to receive an alumina wash coat on which is deposited various catalytic material. This strip is corrugated and in order to prevent nesting of the strip when it is folded back and forth upon itself in a zig-zag or accordion folded manner, the corrugations instead of being peaks and valleys lying along straight lines extended perpendicular to the longitudinal marginal edges of the strip, are provided with a discontinuous configuration such as a plurality of chevron or V-shaped structures. Several such V-shaped displacements causing deviations from a normal straight line have been provided. Also, there has been considered a sinusoidal pattern for the peaks and valleys forming the corrugations.

The gears by which these corrugations are formed have been a series of relatively short helical gears carefully mounted on a shaft and matched so that the indentation imprinted in the surface of the thin metal strip is a V-shaped chevron.

These corrugated metal strips have the principal advantage of being nonnesting when folded back and forth upon themselves in a zig-zag manner.

It has been found, however, that the chevron or V-shaped pattern, especially where there are a plurality of such V-shaped projections across the width of the metal strip have quite unexpectedly shown an unusual type of corrosion failure. After prolonged exposure to high temperature and high hydrocarbon content, corrosion is found to occur at the apices of every other chevron. It was then discovered that those apices which were in compression resisted corrosion, while those apices that were in tension were subject to corrosion. It was further learned that those apices which went through the corrugating gears first were in compression while those which trailed and went through last were found to be in tension and subject to corrosion.

This discovery of the effect of the direction of movement of the apices of chevron shaped projections has been determined to be of great utility in an entirely different aspect. That aspect is this:

It has not been found possible to roll a straight corrugations into a ferritic stainless steel thin metal strip where the peaks and valleys are disposed across the entire width of the strip at an angle to the longitudinal marginal edges of the metal strip. The reason for this is that with a helical gear, in attempting to form such corrugations, the metal strip travels laterally and eventually bunches up and jams the entire apparatus. It has been found that by rolling the metal strip in a manner such that the apices of a single chevron type corrugation are in tension, rather than in compression, and the included angle between the sides of the V-shaped chevron is less than about 166°, the metal strip will split or can be split easily along the line defined by the apices of the chevron into two separate strips each of which has straight corrugations disposed at an angle between the marginal edges of the strip, and avoiding entirely the problem of lateral travelling of the metal strip and bunching and jamming of the rolling gears as described above.

Now, when the corrugated metal strip formed in the manner stated above is folded back and forth upon itself in a zig-zag manner or accordion folded, the resulting bundle is free of any tendency toward nesting. It is much less expensive to manufacture helical gears to insert a single chevron of the type herein contemplated than it is to form a corrugated surface having many chevrons and therefore many apices alternatingly under compression and tension as for example illustrated in the application of Richard C. Cornelison et al, Ser. No. 830,698 filed Feb. 18, 1986 now U.S. Pat. No. 4,711,099. FIGS. 3 and 4 of said Ser. No. 830,698 show helical gears used to corrugate a thin metal strip with a plurality of V-shaped chevrons across the width of the thin metal strip. These helical gears are extremely expensive to manufacture and require a great deal of patience and skill to get properly aligned on the gear supporting shaft. In the present case, there is a pair of oppositely directed confronting helical gears mounted on the same shaft as opposed to a larger plurality of such gears mounted on the shaft. There is, therefore, a great saving in cost of the corrugating apparatus.

BRIEF STATEMENT OF THE INVENTION

Briefly stated, the present invention is in a method for making a corrugated thin metal strip, for example, a ferritic metal strip about 0.003" thick, wherein the corrugations are linear and extend obliquely from longitudinal edge to the opposite longitudinal edge of said strip. This process comprises passing the thin metal strip through corrugating rolls wherein a pair of helical corrugating gears are mounted back to back upon each of a pair of axles for intermeshing contact, and for impressing a series of single apex V-shaped chevron corrugations in which the included angle between the sides of each V-shaped chevron is less than about 166°, and the apex of the V-shaped chevron is the last portion to leave the corrugating rolls whereby the apex is in tension and enables the metal strip to be split at the centrally located apices of the chevrons into two obliquely corrugated metal strips.

BRIEF DESCRIPTION OF THE DRAWINGS

The invention may be better understood by having reference to the annexed drawings wherein.

DETAILED DESCRIPTION OF THE INVENTION

Corrugated metal foil is used to form metal honeycomb catalyst supports for catalytic converters useful in the exhaust systems of internal combustion engines. Such a honeycomb is shown in U.S. Pat. No. 4,300,956. The height of the corrugations is about 1 millimeter, and the spacing (peak-to-peak distance) of the corrugations is about 2 millimeters. When spirally wound or fanfolded, a metal strip so corrugated produces a honeycomb having from 300 to 500 cells per square inch cross section which is the cell density normally used in internal combustion engine catalytic converters. Reference may be had to the application of Retallick Ser. No. 826,896, now abandoned entitled "Rollers for Corrugating Metal Foil" and revealing some of the design considerations involved in forming such rolls.

In the present case, there has been found a unique way for making a corrugated thin metal strip wherein the corrugations lie along a straight line, i.e., without apices or projections displaced from such a straight line and in the direction of movement of the strip through the corrugating rollers. In the present case, the corrugations lie in a straight line which is, however, oblique to the parallel marginal edges of the resulting strip. As indicated above, when it is sought to roll such corrugated strip with a single helically grooved roll or pair of intermeshing rolls, the strip tends to travel to one side or the other and being of such thin section, ultimately destroys itself and jams the apparatus.

The present invention utilizes a metal strip which is desirably twice the width of the final desired width, and wherein a chevron or V-shaped corrugation is intentionally impressed into the surface of the metal strip. When the helical gears are arranged on the shaft so that the apex of the V-shape is the last portion to leave the corrugating gears, the metal at the apex is under relatively high tension. This enables the strip to be split or cut along the line defined by the successive apices to split the strip into two strips each having corrugations which lie on a straight line between marginal edges, and which are oblique thereto by an angle of from about 72 to about 83 degrees. It is not essential, albeit preferred, that the line 22 defined by the apices be centrally located on the metal strip.

Figure 1:
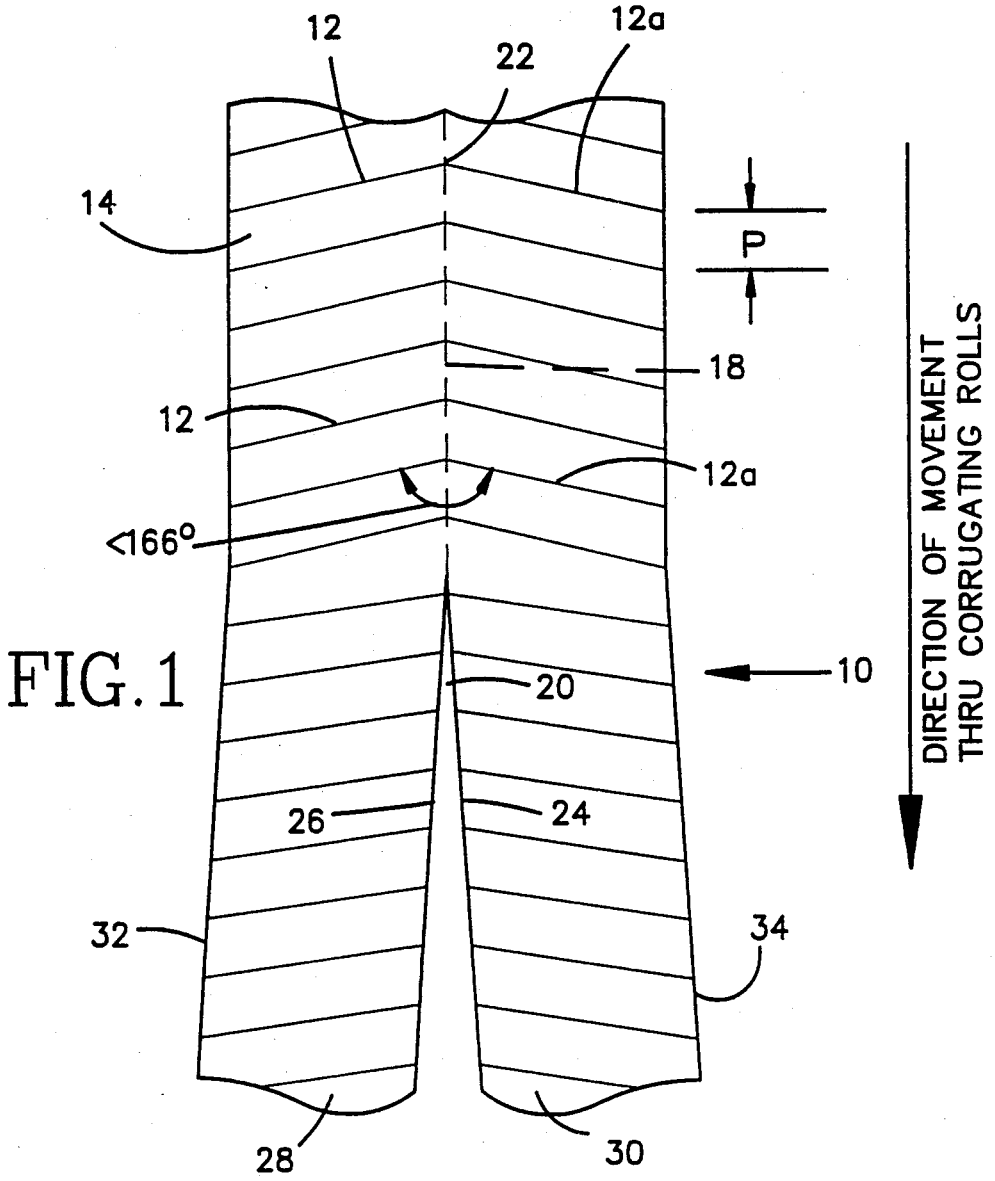
FIG. 1 illustrates a fragment of a V-shaped chevron corrugated thin metal strip in plan form, and showing how the strip is split along a line defined by the apices of the chevrons, and wherein the apices are the last to leave the corrugating rolls for each such successive chevron.
Figure 2:
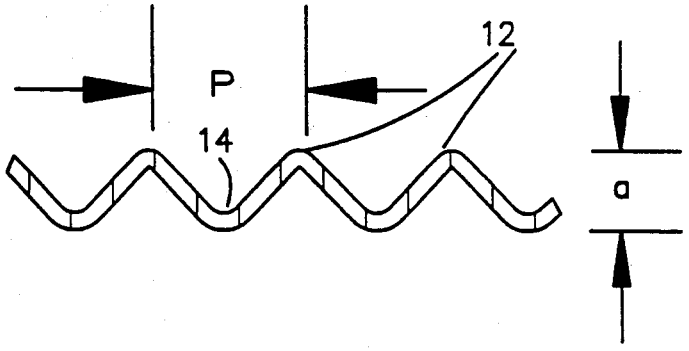
FIG. 2 is a cross-sectional view of the strip shown in FIG. 1 showing the peaks and valleys defining the corrugations.

With more particular reference to FIG. 2, there is here shown a metallic strip 10 having a thickness from about 0.001 to 0.010 inch thick. The strip shown in the annexed drawing has emerged from the corrugating rolls in the direction of the arrow and is composed of a plurality of peaks and valleys, the distance from peak to peak being represented by "p" with a valley in between. As the strip emerges from the corrugating rolls, it will be seen from FIG. 1 that the apices 22 are the last to leave the corrugating rolls. The pattern which is impressed into the surface of the metal strip is a single chevron or V-shaped pattern having peaks defined by the lines 12 and 12A. The lines 12 and 12A intersect at an apex 22 and extend from longitudinal marginal edge 14 to longitudinal marginal edge 16. The apices 22 lie along a common centrally located straight line 18. The included angle between the sides of the V-shaped chevron is less than about 166°, for example, from about 145° to about 165°.

As shown in FIG. 1, because of the high tension stress that occurs at the apices 22, the strip 10 is easily slit or spontaneously splits into two separate strips 28 and 30, the strip 28 having parallel marginal edges 26 and 32, and the strip 30 having parallel marginal edges 24 and 34. It will be observed that the lines 12 and 12A which originally form the V-shaped chevron have now been severed in the leading portions of the strip 10 and form straight lines which are oblique to the marginal edges 32 and 26, and lines 12A which form the other part of the V-shaped chevron are now straight lines extending between the marginal edges 24 and 34 at an oblique angle.

When the strips 28 and 30 have reached a suitable length, they are cut and each can be independently spirally wound or fan folded in an accordion like manner to produce a nonnesting structure. Normally, however, the individual strips are processed, for example, in accordance with the process disclosed in application Ser. No. 830,698 filed Feb. 18, 1986. In accordance with this process, the strip prior to corrugation is an aluminum coated stainless steel strip. The strip is then corrugated, and in the preferred case split along the center line. The individual strips are then treated in accordance with the process of the aforesaid application Ser. No. 830,698 by which the strip is first annealed, provided with a wash coating of aluminum oxide, calcined, and then provided with catalytic materials for infusion into the porous oxide coating. The strip is then folded or wound in either of the manner aforesaid to provide a catalytically active element for inclusion in a catalytic converter housing, these structures being well known in the art.

What is claimed is:

1. A method for making a corrugated thin metal strip wherein the corrugations are linear and extend obliquely from longitudinal marginal edge to the opposite longitudinal marginal edge of said strip, which comprises passing said thin metal strip through corrugating rolls for impressing a series of single apex V-shaped chevron corrugations in which the included angle between the sides of each V-shaped chevron is less than about 166°, and the apex of the V-shaped chevron is the last portion to leave the corrugating rolls whereby the apex is in tension and enables the metal strip to be split into two obliquely corrugated metal strips at the apices of the chevrons, and splitting said metal strip along the apices of said chevrons.

2. A method in accordance with claim 1 wherein the included angle between the sides of V-shaped chevron is from about 165° to about 145°.

3. A method as defined in claim 1 wherein the corrugations have a pitch of about 2 millimeters.

4. A method as defined in claim 1 wherein the corrugations have an altitude of about 1 millimeter.

* * * * *